US006060201A

United States Patent [19]

Kinoshita et al.

[11] Patent Number: 6,060,201

[45] Date of Patent: May 9, 2000

[54] IMAGE FORMING METHOD USING COLOR DEVELOPERS

[75] Inventors: Nobutaka Kinoshita, Mishima; Mitsuo Aoki; Akira Oyamaguchi, both of Numazu, all of Japan

[73] Assignee: Ricoh Company, Ltd., Tokyo, Japan

[21] Appl. No.: 09/422,465

[22] Filed: Oct. 21, 1999

[30] Foreign Application Priority Data

Oct. 21, 1998 [JP] Japan ..... 10-299811

[51] Int. Cl.[7] ..... G03G 9/09; G03G 13/01

[52] U.S. Cl. ..... 430/45; 430/106; 430/110; 430/111

[58] Field of Search ..... 430/45, 106, 110, 430/111

[56] References Cited

U.S. PATENT DOCUMENTS

| | | | |
|---|---|---|---|
| 4,562,136 | 12/1985 | Inoue et al. | 430/110 |
| 4,590,141 | 5/1986 | Aoki et al. | 430/108 |
| 4,908,290 | 3/1990 | Watanabe et al. | 430/109 |
| 4,933,250 | 6/1990 | Nakayama et al. | 430/106 |
| 4,956,258 | 9/1990 | Watanabe et al. | 430/109 |
| 4,980,258 | 12/1990 | Aoki et al. | 430/110 |
| 5,061,588 | 10/1991 | Fushimi et al. | 430/109 |
| 5,380,616 | 1/1995 | Aoki et al. | 430/110 |
| 5,869,213 | 2/1999 | Iwata et al. | 430/106 |
| 5,879,848 | 3/1999 | Kurose et al. | 430/45 |

FOREIGN PATENT DOCUMENTS 6-282102 12/1993 Japan .

OTHER PUBLICATIONS

Fushimi Hiroyuki et al, "Dry Electrophotographic Toner and Dry Process Electrophotographic Method", Patent Abstracts of Japan, Publication No. 09190013, Jul. 22, 1997.

Fujimaki Yoshihide, "Color Image Forming Device", Patent Abstracts of Japan, Publication No. 07271135, Oct. 20, 1995.

Nishimori Yoshiki et al., "Full Color Image Forming Method", Patent Abstracts of Japan, Publication No. 07319316, Dec. 8, 1995.

Oda Yasuhiro et al., "Color Image Forming Method", Patent Abstracts of Japan, Publication No. 07199583, Aug. 4, 1995.

Inaba Koji et al., "Electrostatic Charge Image Developing Toner, Image Forming Method and Color Image Record", Patent Abstracts of Japan, Publication No. 08314300, Nov. 29, 1996.

*Primary Examiner*—Roland Martin

*Attorney, Agent, or Firm*—Oblon, Spivak, McClelland, Maier & Neustadt, P.C.

[57] ABSTRACT

An image forming method including the steps of providing a black toner, a yellow toner, a magenta toner and a cyan toner, wherein each toner includes a binder resin, a colorant and an external additive, wherein the external additive contains a silica, and wherein the content by weight of the external additive in the black toner is greater than any one of those in the yellow, magenta and cyan toner; developing an electrostatic latent image formed on an image bearing member with one of the toners to form a toner image; repeating the developing operation mentioned above using the other toners; transferring the toner images to a receiving material; and heating the toner images using a non-contact fixing device to fix the toner images.

10 Claims, 1 Drawing Sheet

IMAGE FORMING METHOD USING COLOR DEVELOPERS

BACKGROUND OF THE INVENTION

1. Field of the Invention

The present invention relates to an image forming method using color developers, and more particularly to an image forming method using two-component full color developers.

2. Discussion of the Background

Image forming methods using electrophotography are well known. A typical image forming method using electrophotography is as follows:

(1) A photoconductor is entirely charged;

(2) The photoconductor is exposed to imagewise light to form an electrostatic latent image thereon;

(3) The electrostatic latent image is developed with a developer to form a toner image on the photoconductor;

(4) The toner image is transferred to a transfer paper; and (5) The toner image on the transfer paper is heated and/or pressed to be fixed, resulting in formation of a hard copy.

Dry toners for use in these image forming methods typically include a binder resin and a colorant as a main component, and optionally include additives such as charge controlling agents and releasing agents.

Full color images are formed, for example, by the following method:

(1) Four photoconductors are provided and charged:

(2) Each of the photoconductors is exposed to imagewise light corresponding to a yellow, a magenta, a cyan or a black image, to form an electrostatic latent image on each of the photoconductors;

(3) The latent images are developed with a yellow, a magenta, a cyan or a black developer to form a yellow, a magenta, a cyan and a black toner image on the photoconductors;

(4) The yellow, magenta, cyan and black toner image are transferred on a transfer paper one by one to form a full color image on the transfer paper; and (5) The full color image is fixed with heat and/or pressure, resulting in formation of a hard copy having a full color image.

The properties requisite for these toners are good fixing ability, good charging ability, good fluidity, good environmental stability, high mechanical strength, and good ability to be easily pulverized when manufactured. In addition, full color toner images are required to have high gloss and high transparency as well as the properties mentioned above.

A typical method for fixing toner images formed on receiving materials is heat roller fixing methods (a contact fixing method). In this case, when a large-size transfer paper is used as a receiving material, the following problems tend to occur:

(1) The transfer paper is wrinkled when passing through heat rollers because the pressure of the heat rollers is uneven;

(2) The balance in glosses of color toner images is not good; and (2) Resolution of toner images deteriorates because the toner images are excessively pressed when pressed under a pressure condition of conventional image fixing methods.

On the other hand, non-contact fixing methods include flash fixing methods, in which hot air is applied to a transfer paper having toner images to fix the toner images, and oven fixing methods. Oven fixing methods are preferable for fixing full color toners.

In oven fixing methods, a problem of unbalance in glosses of fixed color toner images occurs, i.e., a black toner image has higher gloss than other color toner images, because black toner absorbs heat in an amount greater than other color toners such as yellow, magenta and cyan toners.

In attempting to solve these problems, various techniques have been proposed.

Japanese Laid-Open Patent Publication No. 9-190013 discloses that in contact or non-contact fixing methods clear images can be formed by using a toner including two binder resins whose transition temperatures are different by 5° C. or less. In addition, Japanese Laid-Open Patent Publication No.6-282102 discloses that images which have good melting properties and which are useful for non-contact fixing methods can be formed by using a toner including a resin A and a resin B, wherein each of the resins A and B have a transition temperature higher than 45° C., and the transition temperature of the resin A is not less than 2.5° C. lower than that of the resin B.

In addition, Japanese Laid-Open Patent Publications Nos. 7-271135 and 7-319316 have disclosed that images which can easily be seen can be formed by controlling the difference of gloss between the fixed images area and the non-image area so as to be small. Further, Japanese Laid-Open Patent Publication No. 7-199583 discloses that four color toner images have uniform gloss by controlling the gloss of black toner images so as to be relatively low. Furthermore, Japanese Laid-Open Patent Publication No. 8-314300 discloses a toner including a binder resin having a specified weight average molecular weight and an image forming method which uses the toner and in which the gloss of fixed toner images is determined depending on a predetermined relationship between the gloss and fixing temperature.

However, a method by which color toner images having good image qualities, good reliability and good balance in gloss can be produced has not yet been obtained.

In particular, controlling of transparency and gloss, which are the most important properties requisite for full color toner images, is not satisfactory.

Because of these reasons, a need exists for an image forming method by which color toner images having good image qualities, good reliability and good balance in gloss can be produced.

SUMMARY OF THE INVENTION

Accordingly, an object of the present invention is to provide an image forming method by which color toner images having good image qualities, good reliability and good balance in gloss can be produced.

Briefly this object and other objects of the present invention as hereinafter will become more readily apparent can be attained by an image forming method including the steps of providing a black toner, a yellow toner, a magenta toner and a cyan toner, wherein each toner includes a binder resin, a colorant and an external additive, wherein the external additive contains a silica, and wherein the following relationship is satisfied:

$$WB > WY, WM, WC,$$

wherein WB, WY, WM and WC represent contents by weight of the external additive in the black, yellow, magenta and cyan toner, respectively; developing an electrostatic latent image formed on an image bearing member with one of the toners to form a toner image; repeating the developing step using the other toners to form other toner images; transferring the toner images to a receiving material; and heating the toner images using a non-contacting fixing device to fix the toner images.

Preferably, the quantity of the external additive in the black toner is from 0.5 to 2.0% by weight, and the quantities of the external additive in the yellow, magenta and cyan toner are from 0.3 to 1.5% by weight.

In addition, the external additive preferably includes silica and a titanium oxide. The ratio of the silica to the titanium oxide included in the toners is preferably from 0.7/0.3 to 0.3/0.7.

These toners may be used for developing magnetic latent images as well as electrostatic latent images.

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein.

DETAILED DESCRIPTION OF THE INVENTION

Figure 1:
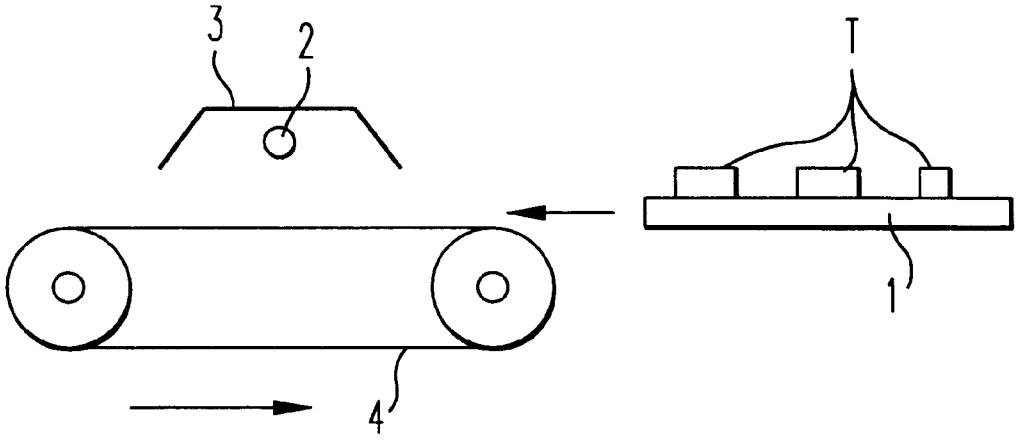
FIG. 1 is a schematic view illustrating an oven fixing device useful for the image forming method of the present invention.

The present invention relates to an image forming method in which color toner images, which are formed using at least a black toner and one or more other color toners, are fixed using a non-contact fixing device such as oven fixing devices and the like.

FIG. 1 is a schematic view illustrating an embodiment of the oven fixing device for use in the present invention. In FIG. 1, a transfer paper 1 having toner images T is fed into between a halogen lamp 2 and a feeding belt 4. Then the transfer paper 1 having toner images T is heated by the halogen lamp 2 while being fed by the feeding belt 4 which moves in a direction indicated by an arrow. Thus, the toner images T are fixed. Numeral 3 denotes a lamp cover.

The present invention provides an image forming method including the steps of providing a black toner, a yellow toner, a magenta toner and a cyan toner, wherein each toner includes a binder resin, a colorant and an external additive, wherein the external additive contains a silica, and wherein the following relationship is satisfied:

$$WB > WY, WM, WC,$$

wherein WB, WY, WM and WC represent contents by weight of the external additive in the black, yellow, magenta and cyan toner, respectively; developing an electrostatic latent image formed on an image bearing member with one of the toners to form a toner image; repeating the developing step mentioned above using the other toners; transferring the toner images to a receiving material; and heating the toner images using an oven fixing device to fix the toner images. At this point, the color toners are not limited to the yellow, magenta and cyan toner. In addition, the latent images to be developed is not limited to electrostatic latent images, and magnetic latent images can also be used.

By including an external additive in a black toner in an amount greater than that of any one of other color toners to control the surface energy of the black toner, color toner images having good balance in gloss can be prepared.

The content of the external additive in a black toner is preferably from 0. 5 to 2.0% by weight, and more preferably from 0.7 to 1.8% by weight. In contrast, the contents of the external additive in color toners other than the black toner are preferably from 0.3 to 1.5% by weight, and more preferably from 0.5 to 1.3% by weight. When the contents of the black toner and other color toners are less than the lower limits, a problem which tends to occur is that the charge increasing properties deteriorate, namely the charge quantity of the toners is too low even when mixed with a carrier and agitated for a predetermined time. When the contents of the black toner and other color toners are greater than the upper limits, problems which tend to occur are that the toners are excessively supplied in quantity when the toners are supplied from a toner bottle to a developing unit, and the charge quantities are easily affected by environmental changes (in particular, by a change of humidity). In addition, to excessively include an external additive to toners, the external additive tends to be transferred to a charge applying material such as a carrier, resulting in deterioration of charge quantity of the toner.

The difference between the content of the external additive in black toner and the content of the external additive in each of the other color toners is preferably from 0.2 to 1.7% by weight, more preferably from 0.3 to 1.7% by weight and even more preferably from 0.5 to 1.6% by weight, to produce color toners having good charge properties and to produce color toner images having a uniform gloss.

Although it is possible to control the gloss of fixed toner images by including only a silica in the toner, it is preferable to include a titanium oxide together with a silica to control the charge quantity of the toner and the gloss of the fixed toner images.

The ratio of a silica to a titanium oxide in the toner for use in the present invention is from 0.7/0.3 to 0.3/0.7, and preferably from 0.6/0.4 to 0.4/0.6, to maintain good balance in gloss of the fixed toner images, good charge increasing properties of the toners which are hardly affected by changes of environmental conditions, and good fluidity of the toners, even when the toners are used for a long time.

Suitable binder resins for use in the toners in the present invention include known resins, which are used as a binder resin for conventional toners, and modified resins and polymer alloys thereof. Specific examples of such resins include styrene type homopolymers and copolymers such as polystyrene resins, polychlorostyrene resins, polyvinyl toluene resins, styrene-vinyl toluene copolymers, styrene-vinyl naphthalene copolymers, styrene-acrylic acid copolymers, styrene-methacrylic acid copolymers, styrene-acrylonitrile copolymers and the like; and other resins such as acrylic resins, vinyl type resins, ethylene resins, polyamide resins, polyester resins, phenolic resins, silicone resins, xylene resins, epoxy resins, terpene resins, rosin, modified rosins and the like. These resins are used alone or in combination.

Suitable colorants for use in the toners in the present invention include known pigments and dyes which are used as a colorant for conventional toners. Specific examples of such pigments and dyes include carbon black, lamp black, iron black, ultramarine blue, Nigrosine dyes, Aniline Blue, chalco-oil blue, Du Pont Oil Red, Quinoline Yellow, Methylene Blue chloride, Phthalocyanine Blue, Phthalocyanine Green, Hansa Yellow, Rhodamine 6C Lake, chrome yellow, quinacridone, Benzidine Yellow, Malachite Green, Malachite Green hexalate, Oil Black, azo oil black, Rose Bengale, monoazo type pigments, disazo type pigments, trisazo type pigments and the like.

These colorants are added to a toner in an amount of from 1 to 20 parts by weight, and preferably from 1 to 15 parts by weight of 100 parts by weight of the toner.

The toner for use in the present invention preferably includes a polarity controlling agent to control the polarity of the toner. Suitable polarity controlling agents for use in the toner in the present invention include Nigrosine dyes, quarternary ammonium salts, polymers having an amino group, azo dyes including a metal, complex compounds of salicylic acid, and phenolic compounds. Among these compounds, quarternary ammonium salts, polymers having an amino group, and complex compounds of salicylic acid are preferable because they do not affect the color properties of the resultant toner.

The external additives for use in the toner in the present invention may include silicas, aluminum oxides and titanium oxides. When it is desired to improve the fluidity of toner particles, silicas or rutile-type titanium oxides, which are treated with a hydrophobic treatment and which have an average primary particle diameter of from 0.001 to 1 $\mu$m and preferably from 0.005 to 0.1 $\mu$m, are preferably included in the toner. More preferably, silicas and titanium oxides, which are treated with an organic silane, are used.

Specific examples of the commercial products of the hydrophobic silica include HDK H 2000, HDK H 2000/4, HDK H 2050EP, and HVK21, which are manufactured by Hoechst AG; R972, R974, RX200, RY200, R202, R805, and R812, which are manufactured by Nippon Aerosil Co.; and TS720 which is manufactured by Cabot Corp. Specific examples of the commercial products of the hydrophobic rutile type titanium oxide include MT-100S, MT-100T, MT-150T, and MT-150AFM, which are manufactured by Tayca Corp.

When the toner for use in the present invention is used as a two-component developer, the toner is used while being mixed with a carrier. Suitable carriers include known materials such as powders of glass, iron, ferrite, nickel, zircon, silica and the like, which preferably have a particle diameter of from 30 to 1000 $\mu$m. In addition, particles in which the powders mentioned above are coated with a resin such as styrene-acrylate copolymers, silicone resins, polyamide resins, and polyvinylidene fluoride and the like can also be used.

Specific examples of the non-contact fixing methods for use in the present invention include known non-contact fixing methods. The fixing conditions are almost the same as those of the known non-contact fixing methods. With respect to the fixing temperature, toner images are preferably fixed under an environmental condition of from 150 to 180° C., and more preferably from 160 to 170° C. in temperature.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were mixed in the ratio mentioned in Table 1, and kneaded while being melted with a two-axis kneader. After being cooled, the kneaded mixture was crushed with a hammer mill, and then filtered to prepare four color powders, Y11 (yellow), M11 (magenta), C11 (cyan) and BK11 (black), each of which had a particle diameter not greater than 2 mm.

TABLE 1

| Material | Y11 | M11 | C11 | BK11 |
|---|---|---|---|---|
| Polyol resin | 93 | 92 | 94 | 94 |
| Negative charge controlling agent | 2 | 2 | 2 | 2 |
| Monoazo type yellow pigment | 5 | — | — | — |
| Quinacridone type magenta pigment | — | 6 | — | — |
| Phthalocyanine type cyan pigment | — | — | 4 | — |
| Carbon black | — | — | — | 4 |

Each of the four color powders was pulverized with a jet pulverizer (Type IDS-2, manufactured by Nippon Pneumatic Mfg. Co. Ltd.), and subjected to a classification treatment to remove fine powders. Thus, mother particles of four color toners, Y21, M21, C21 and BK21, were prepared.

The volume average particle diameter of the mother particles and the content of particles having a diameter not greater than 4 $\mu$m in the mother particles are shown in Table 2.

TABLE 2

| | Y21 | M21 | C21 | BK21 |
|---|---|---|---|---|
| Volume average particle diameter ($\mu$m) | 8.6 | 8.6 | 8.5 | 8.6 |
| Content of particles of not greater than 4 $\mu$m (% by number) | 25 | 23 | 25 | 24 |

Then a surface-treated silica which was an external additive was added to the mother particles of the color toners, each of which had a weight of 2 kg, in such an amount as shown in Table 3, and mixed with a Henshel Mixer having a volume capacity of 20 litters.

Thus, four dry color toners for use in the present invention, Y31, M31, C31 and BK31, were prepared.

TABLE 3

| | Y31 | M31 | C31 | BK31 |
|---|---|---|---|---|
| Amount of surface-treated silica (% by weight) | 2.0 | 2.1 | 1.7 | 2.5 |

Example 2

The procedure for preparation of the four color powders (Y11, M11, C11 and BK11) in Example 1 was repeated. The color powders were pulverized and then classified to prepare mother particles of color toners, Y22, M22, C22 and BK22. The volume average particle diameter thereof and the content of particles having a diameter not greater than 4 $\mu$m therein are shown in Table 4.

TABLE 4

| | Y22 | M22 | C22 | BK22 |
|---|---|---|---|---|
| Volume average particle diameter ($\mu$m) | 9.3 | 9.0 | 9.1 | 9.1 |
| Content of particles of not greater than 4 $\mu$m (% by number) | 20 | 21 | 19 | 18 |

Then a surface-treated silica which was an external additive was added to the mother particles of the color toners, each of which had a weight of 2 kg, in such an amount as shown in Table 5, and mixed with a Henshel Mixer having a volume capacity of 20 litters.

Thus, four color toners for use in the present invention, Y32, M32, C32 and BK32, were prepared.

TABLE 5

| | Y32 | M32 | C32 | BK32 |
|---|---|---|---|---|
| Amount of surface-treated silica (% by weight) | 1.7 | 1.6 | 1.6 | 1.9 |

Example 3

The procedure for preparation of the four color toners in Example 2 was repeated except that the amount of the surface treated silica was changed as shown in Table 6.

Thus, four color toners for use in the present invention, Y33, M33, C33 and BK33, were prepared.

TABLE 6

| | Y33 | M33 | C33 | BK33 |
|---|---|---|---|---|
| Amount of surface-treated silica (% by weight) | 0.3 | 0.3 | 0.3 | 0.6 |

Example 4

The procedure for preparation of the four color powders (Y11, M11, C11 and BK11) in Example 1 was repeated to prepare four color powders Y14, M14. C14 and BK14. The color powders were pulverized and then classified to prepare mother particles of color toners, Y24, M24, C24 and BK24. The volume average particle diameter thereof and the content of particles having a diameter not greater than 4 μm therein are shown in Table 7.

TABLE 7

| | Y24 | M24 | C24 | BK24 |
|---|---|---|---|---|
| Volume average particle diameter (μm) | 8.6 | 8.6 | 8.5 | 8.6 |
| Content of particles of not greater than 4 μm (% by number) | 23 | 23 | 25 | 24 |

Then a surface-treated silica which was an external additive was added to the mother particles of the color toners, each of which had a weight of 2 kg, in such an amount as shown in Table 8, and mixed with a Henshel Mixer having a volume capacity of 20 litters.

Thus, four color toners for use in the present invention, Y34, M34, C34 and BK34, were prepared.

TABLE 8

| | Y34 | M34 | C34 | BK34 |
|---|---|---|---|---|
| Amount of surface-treated silica (% by weight) | 0.7 | 0.8 | 0.7 | 1.0 |

Example 5

The procedure for preparation of the four color toners in Example 4 was repeated except that the amount of the surface-treated silica was changed as shown in Table 9.

Thus, four color toners for use in the present invention, Y35, M35, C35 and BK35, were prepared.

TABLE 9

| | Y35 | M35 | C35 | BK35 |
|---|---|---|---|---|
| Amount of surface-treated silica (% by weight) | 0.4 | 0.5 | 0.5 | 0.6 |

Example 6

The procedure for preparation of the four color powders (Y11, M11, C11 and BK11) in Example 1 was repeated to prepare four color powders Y16, M16. C16 and BK16. The color powders were pulverized and then classified to prepare mother particles of color toners, Y26, M26, C26 and BK26. The volume average particle diameter thereof and the content of particles having a diameter not greater than 4 μm therein are shown in Table 10.

TABLE 10

| | Y26 | M26 | C26 | BK26 |
|---|---|---|---|---|
| Volume average particle diameter (μm) | 7.3 | 7.3 | 7.2 | 7.3 |
| Content of particles of not greater than 4 μm (% by number) | 21 | 21 | 23 | 21 |

Then a silica and an alumina, which were external additives and surface of which had been treated, were added to the mother particles of the color toners, each of which had a weight of 2 kg, in such an amount as shown in Table 11, and mixed with a Henshel Mixer having a volume capacity of 20 litters.

Thus, four color toners for use in the present invention, Y36, M36, C36 and BK36, were prepared.

TABLE 11

| | Y36 | M36 | C36 | BK36 |
|---|---|---|---|---|
| Amount of surface-treated silica (% by weight) | 1.4 | 1.4 | 1.4 | 1.8 |
| Amount of surface-treated alumina (% by weight) | 0.1 | 0.1 | 0.1 | 0.2 |

Example 7

The procedure for preparation of the four color powders (Y11, M11, C11 and BK11) in Example 1 was repeated to prepare four color powders Y17, M17. C17 and BK17. The color powders were pulverized and then classified to prepare mother particles of color toners, Y27, M27, C27 and BK27. The volume average particle diameter thereof and the content of particles having a diameter not greater than 4 μm therein are shown in Table 12.

TABLE 12

| | Y27 | M27 | C27 | BK27 |
|---|---|---|---|---|
| Volume average particle diameter (μm) | 7.0 | 7.1 | 7.0 | 7.1 |
| Content of particles of not greater than 4 μm (% by number) | 26 | 23 | 24 | 23 |

Then a silica and a titanium oxide, which were external additives and surface of which had been treated, were added to the mother particles of the color toners, each of which had a weight of 2 kg, in such an amount as shown in Table 13, and mixed with a Henshel Mixer having a volume capacity of 20 litters.

Thus, four color toners for use in the present invention, Y37, M37, C37 and BK37, were prepared.

TABLE 13

| | Y37 | M37 | C37 | BK37 |
|---|---|---|---|---|
| Amount of surface-treated silica (% by weight) | 0.4 | 0.3 | 0.4 | 0.7 |
| Amount of surface-treated titanium oxide (% by weight) | 0.3 | 0.3 | 0.2 | 0.5 |

Example 8

The procedure for preparation of four color powders (Y11, M11, C11 and BK11) in Example 1 was repeated to prepare four color powders Y18, M18. C18 and BK18. The color powders were pulverized and then classified to prepare mother particles of color toners, Y28, M28, C28 and BK28. The volume average particle diameter thereof and the content of particles having a diameter not greater than 4 μm therein are shown in Table 14.

TABLE 12

| | Y28 | M28 | C28 | BK28 |
|---|---|---|---|---|
| Volume average particle diameter (μm) | 7.1 | 7.2 | 7.0 | 7.3 |
| Content of particles of not greater than 4 μm (% by number) | 24 | 23 | 26 | 23 |

Then a silica and a titanium oxide, which were external additives and surface of which had been treated, were added to the mother particles of the color toners, each of which had a weight of 2 kg, in such an amount as shown in Table 15 (the mixing ratio of the silica to the titanium oxide was 0.7/0.3), and mixed with a Henshel Mixer having a volume capacity of 20 litters.

Thus, four color toners for use in the present invention, Y38, M38, C38 and BK38, were prepared.

TABLE 15

| | Y38 | M38 | C38 | BK38 |
|---|---|---|---|---|
| Amount of surface-treated silica (g) | 7.0 | 7.0 | 7.0 | 14.0 |
| Amount of surface-treated titanium oxide (g) | 3.0 | 3.0 | 3.0 | 6.0 |

Example 9

The procedure for preparation of the four color toners in Example 8 was repeated except that the mixing ratio of the silica to the titanium oxide was changed from 7/3 to 3/7, as shown in Table 16.

Thus, four color toners, Y39, M39, C39 and BK39 for use in the present invention were prepared.

TABLE 16

| | Y39 | M39 | C39 | BK39 |
|---|---|---|---|---|
| Amount of surface-treated silica (g) | 3.0 | 3.0 | 3.0 | 6.0 |
| Amount of surface-treated titanium oxide (g) | 7.0 | 7.0 | 7.0 | 14.0 |

Comparative Example 1

The procedure for preparation of the four color powders (Y11, M11, C11 and BK11) in Example 1 was repeated to prepare four color powders Y101, M101, C101 and BK101. The color powders were pulverized and then classified to prepare mother particles of color toners, Y201, M201, C201 and BK201. The volume average particle diameter thereof and the content of particles having a diameter not greater than 4 μm therein are shown in Table 17.

TABLE 17

| | Y201 | M201 | C201 | BK201 |
|---|---|---|---|---|
| Volume average particle diameter (μm) | 9.0 | 9.0 | 9.1 | 9.1 |
| Content of particles of not greater than 4 μm (% by number) | 20 | 21 | 19 | 18 |

Then a surface-treated silica which was an external additive was added to the mother particles of the color toners, each of which had a weight of 2 kg, in such an amount as shown in Table 18, and mixed with a Henshel Mixer having a volume capacity of 20 litters.

Thus, four comparative color toners, Y301, M301, C301 and BK301, were prepared.

TABLE 18

| | Y301 | M301 | C301 | BK301 |
|---|---|---|---|---|
| Amount of surface treated silica (% by weight) | 1.6 | 1.7 | 1.7 | 1.2 |

Comparative Example 2

The procedure for preparation of the four color powders (Y11, M11, C11 and BK11) in Example 1 was repeated to prepare four color powders Y102, M102, C102 and BK102. The color powders were pulverized and then classified to prepare mother particles of color toners, Y202, M202, C202 and BK202. The volume average particle diameter thereof and the content of particles having not greater than 4 μm therein are shown in Table 19.

TABLE 19

| | Y202 | M202 | C202 | BK202 |
|---|---|---|---|---|
| Volume average particle diameter (μm) | 7.2 | 7.2 | 7.3 | 7.2 |
| Content of particles of not greater than 4 μm (% by number) | 22 | 23 | 21 | 23 |

Then a surface-treated silica which was an external additive was added to the mother particles of the color toners, each of which had a weight of 2 kg, in such an amount as shown in Table 20, and mixed with a Henshel Mixer having a volume capacity of 20 litters.

Thus, four comparative dry color toners, Y301, M301, C301 and BK301, were prepared.

TABLE 20

| | Y302 | M302 | C302 | BK302 |
|---|---|---|---|---|
| Amount of surface-treated silica (% by weight) | 2.5 | 2.5 | 2.5 | 2.5 |

Comparative Example 3

The procedure for preparation of the four color powders (Y11, M11, C11 and BK11) in Example 1 was repeated to prepare four color powders Y103, M103. C103 and BK103. The color powders were pulverized and then classified to prepare mother particles of color toners, Y203, M203, C203 and BK203. The volume average particle diameter thereof and the content of particles having a diameter not greater than 4 μm therein are shown in Table 21.

TABLE 21

| | Y203 | M203 | C203 | BK203 |
|---|---|---|---|---|
| Volume average particle diameter (μm) | 7.2 | 7.2 | 7.3 | 7.2 |
| Content of particles of not greater than 4 μm (% by number) | 22 | 23 | 21 | 23 |

Then a silica and a titanium oxide, which were external additives and surface of which had been treated, were added to the mother particles of the color toners, each of which had a weight of 2 kg, in such an amount as shown in Table 22 (the mixing ratio of the silica to the titanium oxide was 0.8/0.2), and mixed with a Henshel Mixer having a volume capacity of 20 litters.

Thus, four comparative dry color toners, Y303, M303, C303 and BK303, were prepared.

TABLE 22

| | Y303 | M303 | C303 | BK303 |
|---|---|---|---|---|
| Amount of surface-treated silica (g) | 16.0 | 16.0 | 16.0 | 8.0 |
| Amount of surface-treated titanium oxide (g) | 4.0 | 4.0 | 4.0 | 2.0 |

Comparative Example 4

The procedure for preparation of the four color powders (Y11, M11, C11 and BK11) in Example 1 was repeated to prepare four color powders Y104, M104. C104 and BK104. The color powders were pulverized and then classified to prepare mother particles of color toners, Y204, M204, C204 and BK204. The volume average particle diameter thereof and the content of particles having a diameter not greater than 4 μm therein are shown in Table 23.

TABLE 23

| | Y204 | M204 | C204 | BK204 |
|---|---|---|---|---|
| Volume average particle diameter (μm) | 7.2 | 7.3 | 7.2 | 7.2 |
| Content of particles of not greater than 4 μm (% by number) | 22 | 22 | 23 | 23 |

Then a silica and a titanium oxide, which were external additives and surface of which had been treated, were added to the mother particles of the color toners, each of which had a weight of 2 kg, in such an amount as shown in Table 24 (the mixing ratio of the silica to the titanium oxide was 0.8/0.8), and mixed with a Renshel Mixer having a volume capacity of 20 litters.

Thus, four comparative dry color toners, Y304, M304, C304 and BK304, were prepared.

TABLE 24

| | Y304 | M304 | C304 | BK304 |
|---|---|---|---|---|
| Amount of surface-treated silica (g) | 8.0 | 8.0 | 8.0 | 4.0 |
| Amount of surface-treated titanium oxide (g) | 8.0 | 8.0 | 8.0 | 4.0 |

Method for evaluating toners

1. Charge properties

The charge quantity of each of the color toners of Examples 1 to 9 and Comparative Examples 1 to 4 was measured by a blow-off method in which a carrier and a toner in a developer are separated and then the charge quantity and weight of the toner are measured to determine the charge quantity per unit weight. The unit is—μc/g.

2. Image qualities

Five parts of each of the color toners of Examples 1 to 9 and Comparative Examples 1 to 4 were mixed with 95 parts of a carrier which was coated with a silicone resin and whose particle size was 80 μm to prepare two-component developers.

A set of four color developers (for example, developers of the toners, Y31, M31, C31 and BK31) was installed in the respective developing units of a full color electrophotographic copier, PRETER 550 manufactured by Ricoh Co., Ltd. The copier uses a developing method using a magnet brush and a two component developer, and an image transfer method using an intermediate transfer belt. A yellow, magenta, cyan and black color image, which were not fixed, were prepared on respective transfer papers. Then each of the transfer papers having a yellow, magenta, cyan and black toner image was heated with a halogen lamp having a color temperature of 2500° C. while being fed at a speed of 200 mm/sec to fix the toner images. The temperature of the atmosphere of the image fixing part was from 150 to 180° C.

The fixed color toner images were visually observed to evaluate the image qualities. The image qualities were classified into the following 3 ranks:

◎: The balance of the resultant black toner and the other color images in gloss is very good;

○; The balance of the resultant black toner and the other color images in gloss is good;

×; The balance of the resultant black toner and the other color images in gloss is not good because the gloss of the black toner image is good but the gloss of the other color toner images is poor.

The gloss of each of the fixed color toner images was measured with a gloss meter VGS-1D manufactured by NIPPON DENSHOKU KOGYO CO., LTD. such that light reflected at an angle of 60° was measured.

In addition, 20000 copies were continuously produced to determine whether the carrier of the developer was deteriorated or not. The deterioration of the carrier was determined by measuring the charge quantity of the toner of the developer by the blow-off method mentioned above.

The results are shown in Table 25.

TABLE 25

| | Gloss (%) | | | | Image | Deterioration | Charge quantity (−μC/g) | | | |
|---|---|---|---|---|---|---|---|---|---|---|
| | Y | M | C | BK | quality | of carrier | Y | M | C | BK |
| Ex. 1 | 20.8 | 21.4 | 21.4 | 21.6 | ○ | Slight | 36 | 32 | 33 | 29 |
| Ex. 2 | 19.3 | 19.9 | 19.5 | 20.0 | ○ | Slight | 35 | 33 | 34 | 30 |
| Ex. 3 | 8.8 | 9.3 | 9.3 | 10.2 | ○ | Slight | 32 | 29 | 30 | 25 |
| Ex. 4 | 14.9 | 15.0 | 15.0 | 15.3 | ○–◎ | None | 34 | 30 | 31 | 27 |
| Ex. 5 | 9.3 | 9.5 | 9.4 | 10.0 | ◎ | None | 33 | 30 | 30 | 26 |
| Ex. 6 | 17.2 | 17.4 | 17.3 | 17.5 | ◎ | None | 36 | 34 | 35 | 30 |
| Ex. 7 | 9.2 | 9.3 | 9.3 | 10.3 | ◎ | None | 34 | 30 | 31 | 37 |
| Ex. 8 | 23.3 | 23.4 | 23.4 | 23.6 | ◎ | None | 35 | 32 | 33 | 28 |
| Ex. 9 | 18.7 | 18.9 | 18.9 | 18.9 | ◎ | None | 31 | 29 | 30 | 25 |
| Comp. Ex. 1 | 7.0 | 7.8 | 7.6 | 15.3 | x | Slight | 35 | 33 | 34 | 28 |
| Comp. Ex. 2 | 20.2 | 21.5 | 21.0 | 23.6 | x | Slight | 37 | 33 | 34 | 31 |
| Comp. Ex. 3 | 20.1 | 21.3 | 20.8 | 23.4 | x | Slight | 35 | 33 | 34 | 30 |
| Comp. Ex. 4 | 20.0 | 21.3 | 20.9 | 23.4 | x | Slight | 34 | 33 | 34 | 29 |

Table 25 clearly indicates that the image forming method of the present invention can produce color toner images having good image qualities and good balance in gloss. In addition, in the image forming method of the present invention a problem such as deterioration of carrier does not occur.

This document claims priority and contains subject matter related to Japanese Patent Application No. 10-299811, filed on Oct. 21, 1998, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming method comprising the steps of:

providing a black toner, a yellow toner, a magenta toner and a cyan toner, wherein each toner comprises a binder resin, a colorant, and an external additive, wherein the external additive contains a silica, and wherein the following relationship is satisfied:

$$WB > WY, WM, WC,$$

wherein WB, WY, WM and WC represent contents by weight of the external additive in the black, yellow, magenta and cyan toner, respectively;

developing an electrostatic latent image formed on an image bearing member with one of the toners to form a toner image;

repeating the developing step using the other toners to form toner images of the other toners;

transferring the toner images to a receiving material; and heating the toner images using a non-contact fixing device to fix the toner images.

2. The image forming method according to claim 1, wherein the non-contact fixing device is an oven fixing device.

3. The image forming method according to claim 1, wherein WB is from 0.5 to 2.0% by weight.

4. The image forming method according to claim 1, wherein each of WY, WM and WC is independently from 0.3 to 1.5% by weight.

5. The image forming method according to claim 1, wherein the external additive contains two or more compounds.

6. The image forming method according to claim 5, wherein the external additive contains a silica and a titanium oxide.

7. The image forming method according to claim 6, wherein the ratio of the silica to the titanium oxide is from 0.7/0.3 to 0.3/0.7.

8. An image forming method comprising the steps of:

providing a black toner, and one or more color toners, wherein each toner comprises a binder resin, a colorant and an external additive, wherein the external additive contains a silica, and wherein the content of the external additive in the black toner is greater than those in said one or more color toners;

developing an electrostatic latent image formed on an image bearing member with one of the toners to form a toner image;

repeating the developing step using the other toner or toners to form a toner image or toner images of the other toner or toners;

transferring the toner images to a receiving material; and heating the toner images using a non-contact fixing device to fix the toner images.

9. An image forming method comprising the steps of:

providing a black toner, and one or more color toners, wherein each toner comprises a binder resin, a colorant and an external additive, wherein the external additive contains a silica, and wherein the content of the external additive in the black toner is greater than those in said one or more color toners;

developing a magnetic latent image formed on an image bearing member with one of the toners to form a toner image;

repeating the developing step using the other toner or toners to form a toner image or toner images of the other toner or toners;

transferring the toner images to a receiving material; and heating the toner images using a non-contact fixing device to fix the toner images.

10. A toner kit suitable for developing electrostatic latent images, which is fixed using a non-contact fixing device, to form a color image including a black toner, a yellow toner, a magenta toner and a cyan toner, wherein each toner comprises a binder resin, a colorant and an external additive, wherein the external additive contains a silica, and wherein the following relationship is satisfied:

$$WB > WY, WM, WC,$$

wherein WB, WY, WM and WC represent contents by weight of the external additive in the black, yellow, magenta and cyan toner, respectively.

* * * * *